US007331148B2

(12) United States Patent
Di Lorenzo

(10) Patent No.: US 7,331,148 B2
(45) Date of Patent: Feb. 19, 2008

(54) STUD FOR CONCRETE FORMS AND FORMS USING SUCH STUDS

(75) Inventor: Nick Di Lorenzo, Weston (CA)

(73) Assignee: Brentmuir Developments (1993) Ltd., Weston (CA)

( * ) Notice: Subject to any disclaimer, the term of this patent is extended or adjusted under 35 U.S.C. 154(b) by 570 days.

(21) Appl. No.: 10/377,623

(22) Filed: Mar. 4, 2003

(65) Prior Publication Data

US 2004/0172891 A1 Sep. 9, 2004

(51) Int. Cl.
*E04G 11/00* (2006.01)

(52) U.S. Cl. ..... 52/481.1; 52/475.1; 52/476; 52/478; 52/481.2; 52/763; 52/764; 52/781.5; 52/422; 52/426; 52/434; 52/442; 52/562; 249/18; 249/33; 249/38

(58) Field of Classification Search ..... 52/730.4, 52/309.17, 562, 481.1, 475.1, 476, 481.2, 52/769, 762–781, 781.5, 561–572, 421–429, 52/430–442, 478; 249/18, 33, 38
See application file for complete search history.

(56) References Cited

U.S. PATENT DOCUMENTS 1,387,809 A * 8/1921 Simons ..... 138/115
1,686,373 A * 10/1928 Foster ..... 52/289
1,720,306 A * 7/1929 Tremper ..... 138/115
2,023,023 A * 12/1935 Kaufman ..... 52/98
2,047,882 A * 7/1936 McPherson ..... 52/347
2,086,989 A * 7/1937 Raad ..... 52/100
2,186,712 A * 1/1940 Stamm et al. ..... 52/608
2,316,319 A * 4/1943 Demarest ..... 138/115
2,433,934 A * 1/1948 Symons ..... 249/190
2,784,476 A * 3/1957 Bergdal ..... 249/218
2,902,744 A * 9/1959 Patterson et al. ..... 269/234
2,976,597 A * 3/1961 Elam ..... 249/47
3,074,141 A * 1/1963 Bowden et al. ..... 249/214
3,204,918 A * 9/1965 Bonin et al. ..... 249/191
3,263,956 A * 8/1966 Hawkins ..... 249/40
3,396,936 A * 8/1968 Bowden ..... 249/214
3,420,491 A * 1/1969 Gilbert et al. ..... 249/216
3,477,684 A * 11/1969 Dagiel ..... 249/189
3,661,354 A * 5/1972 Dagiel et al. ..... 249/192
3,690,613 A * 9/1972 Shoemaker ..... 249/40
3,730,476 A 5/1973 Prichard, Jr.
3,785,610 A * 1/1974 Dagiel ..... 249/214
3,899,155 A 8/1975 Ward
3,981,476 A * 9/1976 Alexander et al. ..... 249/42
3,995,825 A 12/1976 Ward (Continued)

*Primary Examiner*—Jeanette Chapman
(74) *Attorney, Agent, or Firm*—Santosh K. Chari; Blake, Cassels & Graydon LLP

(57) ABSTRACT

A concrete form comprises cross members, plywood, and metal studs. The studs include a front wall, a rear wall, and a pair of side walls, the walls arranged to form a generally rectangular cross-section. A pair of inner walls extends between and perpendicular to the pair of side walls. A pair of flanges extends from the side walls. The flanges are aligned with each other and positioned between the front wall and the pair of inner walls. A portion of each stud is adapted for complementary engagement with the cross members. The cross members are attached to at least one of the inner walls and the flanges of the cut portion of the studs, and the plywood is mounted to the rear wall.

8 Claims, 6 Drawing Sheets

U.S. PATENT DOCUMENTS 4,001,993 A 1/1977 Daniel
4,030,694 A * 6/1977 Schimmel ..... 249/196
4,034,957 A * 7/1977 Cody ..... 249/189
4,087,072 A * 5/1978 Olsen ..... 249/129
4,145,024 A 3/1979 Ward
4,234,156 A * 11/1980 Wepf ..... 249/40
4,291,858 A * 9/1981 NeSmith ..... 249/216
4,333,289 A 6/1982 Strickland
4,385,745 A 5/1983 Bennett
4,409,764 A 10/1983 Wilnau
4,646,496 A * 3/1987 Wilnau ..... 52/252
4,793,113 A 12/1988 Bodnar
4,889,310 A 12/1989 Boeshart
4,916,879 A * 4/1990 Boeshart ..... 52/426
5,140,794 A 8/1992 Miller
5,440,848 A 8/1995 Deffet
5,596,859 A 1/1997 Horton
5,651,910 A 7/1997 Myers
5,678,958 A * 10/1997 Rossi ..... 405/286
5,735,090 A * 4/1998 Papke ..... 52/220.2
5,740,644 A 4/1998 Menchetti
5,740,648 A * 4/1998 Piccone ..... 52/426
5,782,050 A * 7/1998 Boeshart ..... 52/426
5,845,445 A * 12/1998 Blackbeard ..... 52/426
5,861,105 A 1/1999 Martineau
5,992,123 A * 11/1999 Kies ..... 52/719
6,016,632 A 1/2000 McGee
6,021,994 A * 2/2000 Shartzer, Jr. ..... 249/6
6,145,257 A 11/2000 Cappuccio
6,145,263 A * 11/2000 Eckerd ..... 52/508
6,212,845 B1 * 4/2001 De Zen ..... 52/607
6,658,810 B2 * 12/2003 DeLoach, Sr. ..... 52/701
6,742,758 B2 * 6/2004 Janesky ..... 249/7
6,799,405 B2 * 10/2004 Gilbert ..... 52/604
6,910,672 B2 * 6/2005 Hufnagel ..... 249/35

* cited by examiner

STUD FOR CONCRETE FORMS AND FORMS USING SUCH STUDS

BACKGROUND OF THE INVENTION

1. Field of the Invention

The present invention relates to concrete forms, and more specifically to studs used in the manufacture of concrete forms.

2. Description of the Prior Art

When concrete is poured, a form is usually built from plywood panels reinforced using 2" by 4" studs. Studs attach to the plywood, and cross members, known in the industry as walers, attach to the vertical studs for strength. The cross members are usually made out of wood. The cross members reinforce the form to keep it from buckling or bending under the force of the concrete when it is poured. Tie bars connect opposite sides of the form in order to hold them together against the force of the concrete. After the concrete is set, these forms are removed from the concrete, leaving a finished concrete wall.

The forms are prone to damage during transportation, installation, removal and storage. The primary cause of this damage relates to wear and deterioration of the wood forming the form structure. When forms are damaged, they must either be structurally reinforced or replaced. This, of course, leads to considerable cost and time requirements. Such costs outweigh any cost savings in using inexpensive wood studs.

Plywood panels are manufactured in standard sizes, and as such may be replaced with off-the-shelf components. However, the 2"×4" wooden studs must be cut to size for each form. When the old studs deteriorate, replacement studs must be cut to fit the form, thus requiring that essentially the entire form be rebuilt. Rebuilding the forms requires considerable cost and time requirements.

An object of the present invention is to obviate or mitigate some of the disadvantages outlined above.

SUMMARY OF THE INVENTION

In accordance with one aspect of the present invention, there is provided a stud comprising:

a) a front wall, a rear wall, and a pair of side walls, the walls arranged to form a generally rectangular cross-section;

b) a pair on inner walls extending between the pair of side walls; and a pair of flanges extending from the side walls, the flanges being aligned with each other and positioned between the front wall and the pair of inner walls.

In accordance with another aspect of the present invention, there is provided a concrete form including a plurality of cross members, a sheet of wood, and a plurality of studs. The studs have a front wall, a rear wall, and a pair of side walls, with the walls arranged to form a generally rectangular cross-section. A pair of inner walls extend between the pair of side walls. A pair of flanges extend from the side walls. The flanges are aligned with each other and are positioned between the front wall and the pair of inner walls. A portion of the studs is adapted for complementary engagement with the cross members. The cross members are attached to at least one of the inner walls and the flanges of the cut portion of the studs. The wood is mounted to the rear wall.

In one aspect, the present invention provides a concrete form comprising:

a plurality of cross member;

a sheet of rigid material, such as a wood sheet; and a plurality of studs having:

(a) a front wall, a rear wall, and a pair of side walls, the walls arranged to form a rectangular cross-section;

(b) a pair of inner walls extending between the pair of side walls; and (c) a pair of opposed flanges, each one of the flanges extending substantially perpendicularly from a respective one of the side waits and extending towards the other of the side walls;

wherein a portion of the studs is adapted for complementary engagement with the cross members, the cross members connecting at least two of the studs and being attached to at least one of the inner walls and the flanges of the cut portion of the studs, and the sheet of rigid material is mounted to the rear wall;

and wherein the cross members include end cross members and center cross members, the center cross members being attached to the inner walls and the end cross members being attached to the flanges.

In another aspect, the present invention provides a concrete form comprising a pair of opposing panels, each of the panels comprising:

(a) a plurality of studs arranged in a spaced apart parallel manner with respect to each other, each of the studs comprising a generally hollow elongate member having:

(i) a front wall, a rear wall, and first and second side walls, the side walls being spaced apart from each other and each extending between the front and rear walls to provide the stud with a generally rectangular cross-section;

(ii) at least one rib extending between and connecting the pair of side walls; and, (iii) a pair of opposed flanges, each one of the flanges extending substantially perpendicularly from a respective one of the side walls and extending towards the other of the side walls;

the studs being arranged in a planar manner with the respective front and rear walls extending in the same direction;

(b) a plurality of cross members, extending perpendicularly between and connected to at least two of the studs and being arranged in a spaced apart parallel manner with respect to each other, the cross members being provided generally perpendicular to the studs and connected thereto, and wherein the cross members are provided adjacent the front walls of the studs and wherein the cross members include a narrow portion and a wide portion forming a generally "T" shaped structure; and, (c) a sheet of rigid material, such as a wood sheet, overlying and connected to the rear walls of the plurality of studs;

wherein the studs are adapted for complementary engagement with the cross members, the cross members being attached to at least one of the rib or the flanges of a cut portion of the studs;

and wherein the panels are arranged in a parallel and spaced apart relationship to each other with the sheets of rigid material facing each other.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
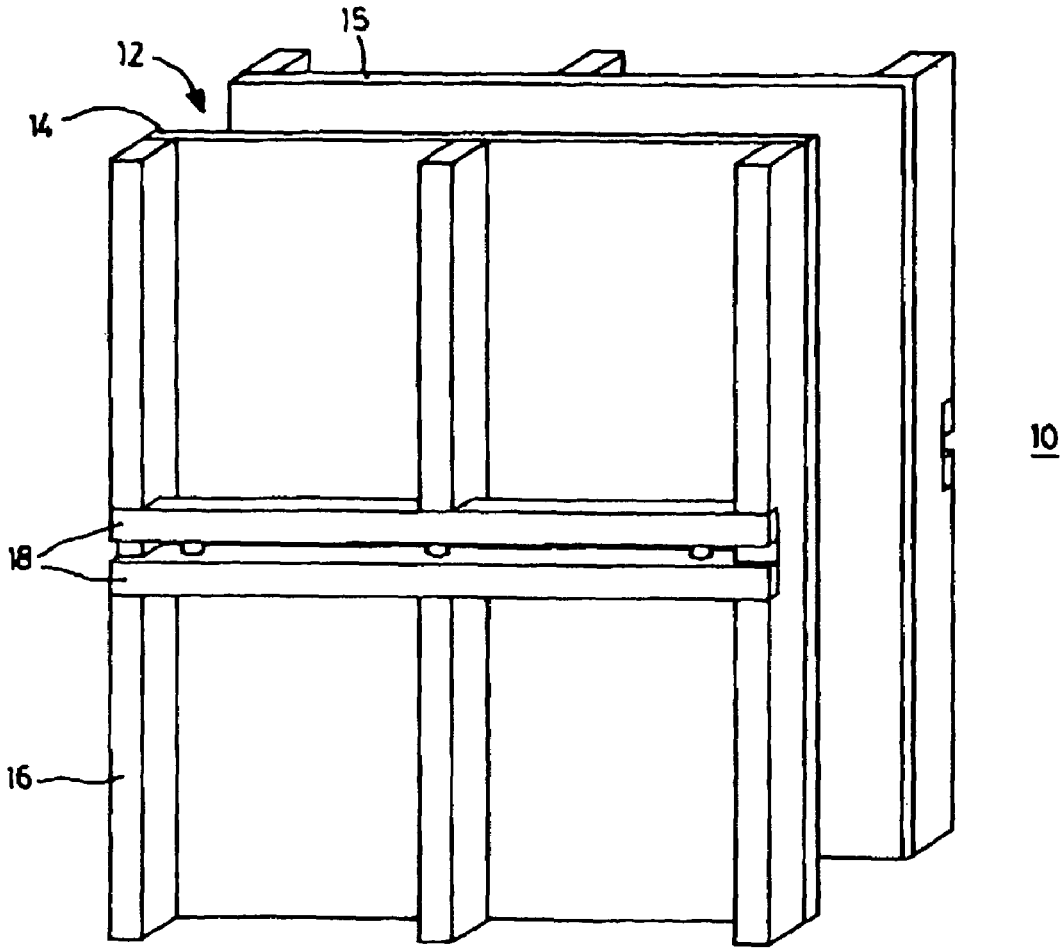
FIG. 1 is a schematic representation of a form.

Referring to FIG. 1, a form used when pouring concrete is shown generally by the numeral 10. The form generally comprises wood sheets 14 and 15 (such as plywood sheets), studs 16, and cross members 18. The wood sheets 14 and 15 are spaced apart and aligned with each other to form two sides of a generally rectangular space 12. The wood sheets 14 and 15 are preferably 4'×8' plywood sheets. The studs 16 are preferably 2"×4" hollow metal studs, and are described more fully below with reference to FIGS. 5 and 6. The cross members 18 are described below with reference to FIGS. 2, 3, and 4.

In an exemplary construction, the studs 16 span the length of the wood sheets and are spaced along the width of the wood sheets. The studs 16 are screwed to the wood sheets. Cross members 18 are placed so that they span the width of the wood sheets, are spaced along the length of the wood sheet, and intersect the studs 16. The studs 16 and cross members 18 are screwed together to reinforce the wood sheets 14 and 15 respectively. The wood sheets 14 and 15 are thus reinforced by spacing the studs 16 along the width of the wood sheets, and spacing the cross members 18 along the length of the wood sheets. In the preferred embodiment, the cross members 18 span three studs 16, with two of the studs 16 at opposite ends of the wood sheet, and the third stud 16 in the middle of the wood sheet.

The form 10 is used when pouring a concrete wall. The form 10 is placed into position, with the wood sheets 14 and 15 placed at the desired positions of the inner and outer surfaces of the concrete wall. Concrete is poured into the space 12 formed between the wood sheets 14 and 15. The studs 16 and cross members 18 reinforce the wood sheets 14 and 15 against the hydrostatic pressure of the concrete. After the concrete has set, the form is removed, leaving the finished concrete wall. The inner and outer surfaces of the concrete wall are then located at the former positions of the wood sheets 14 and 15.

Figure 2:
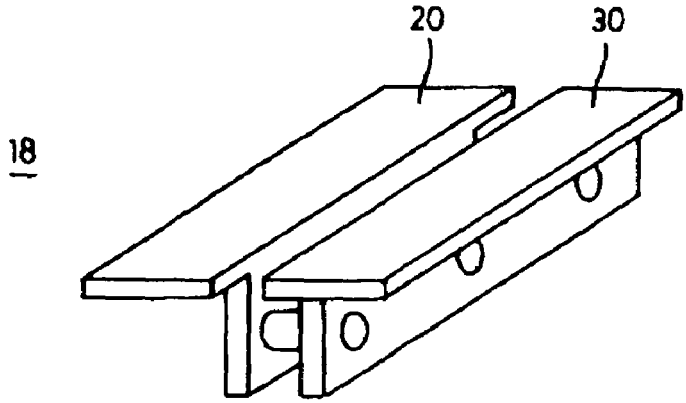
FIG. 2 is a perspective view of a cross member in FIG. 1.
Figure 3:
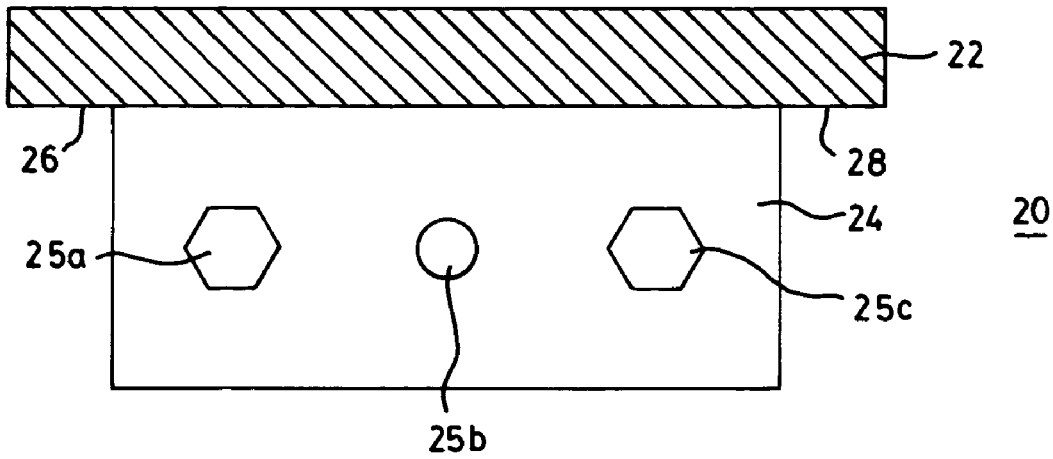
FIG. 3 is a top view the cross member of FIG. 2.
Figure 4:
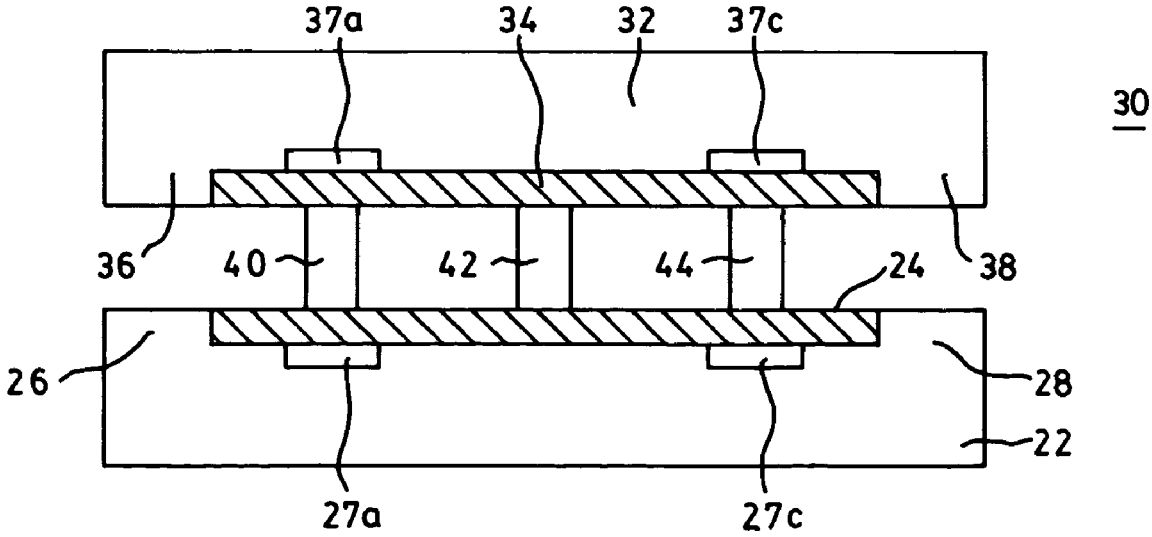
FIG. 4 is a back view of the cross member FIG. 2.

Referring to FIGS. 2, 3 and 4, the cross member 18 is shown in more detail. The cross member 18 comprises two members 20, 30, which are L-shaped in end view, and of substantially similar construction. As seen best in FIG. 3, the member 20 comprises a surface 22 and a flange 24 positioned at one side of surface 22, extending outward from the surface 22, and preferably perpendicular to the surface 22. The flange 24 is inset from each end of the surface 22 to expose two flat portions 26, 28 at opposite ends of the surface 22. The member 30 has corresponding wall 32, flange 34, and flat portions 36, 38. The two members 20, 30 are placed in opposite orientations so that the sides of surfaces 22 and 32 with flanges 24 and 34 are facing each other. The flanges 24 and 34 are attached together by bolts 40, 44 and pin 42 disposed through holes 25*a*, 25*b*, and 25*c* in flanges 24 and 34, thereby connecting the two members 20, 30. Bolt 40 is held in place by nuts 27*a*, 37*a*, and bolt 44 is held in place by nuts 27*c*, and 37*c*. The nuts 27*a*, 37*a*, 27*c*, and 37*c* may be tightened to adjust the spacing and relative positioning of members 20, 30. Preferably, the members 20, 30 are in generally parallel alignment, and more preferably in parallel alignment.

Figure 5:
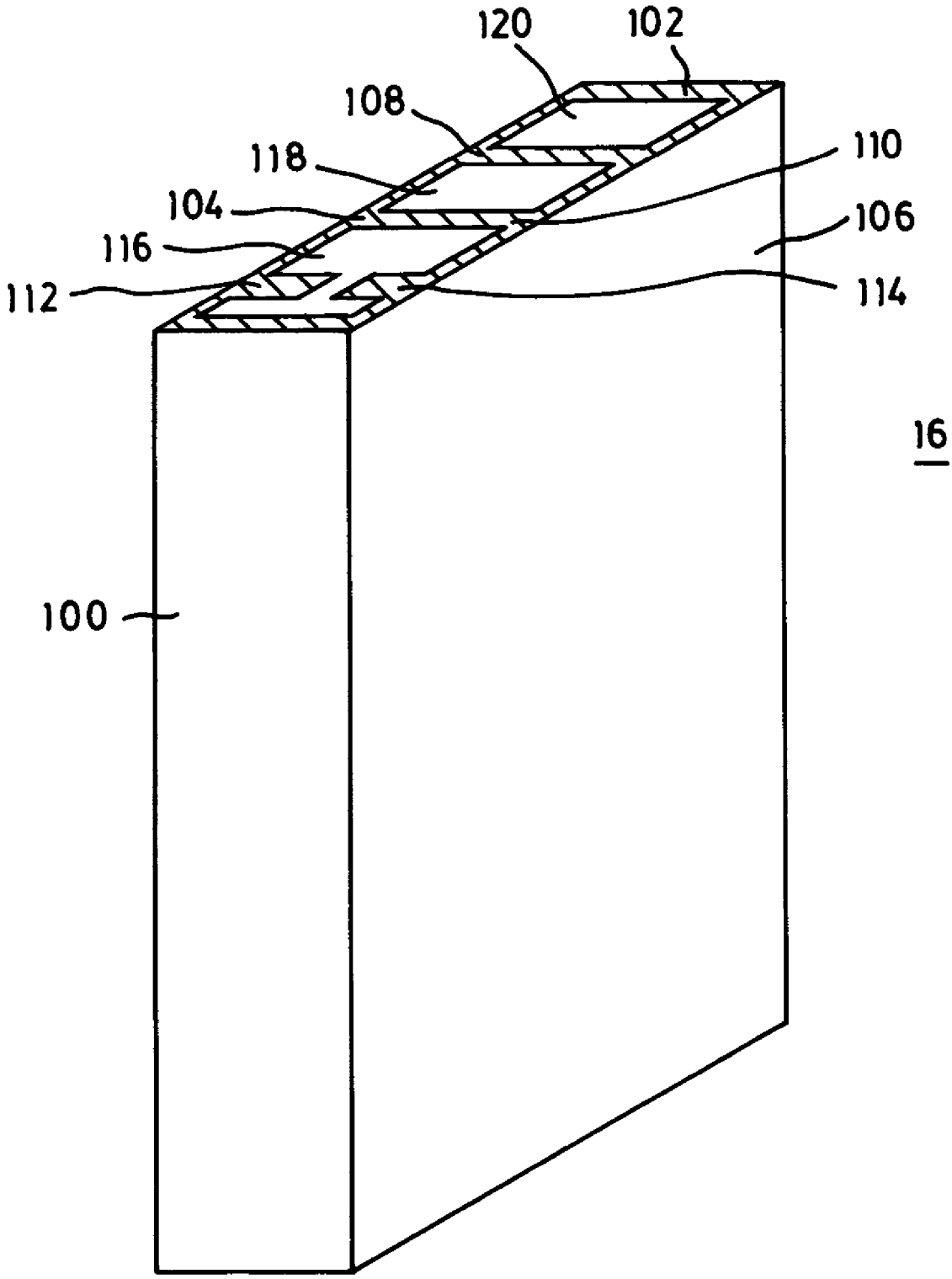
FIG. 5 is a perspective view of a stud of FIG. 1.
Figure 6:
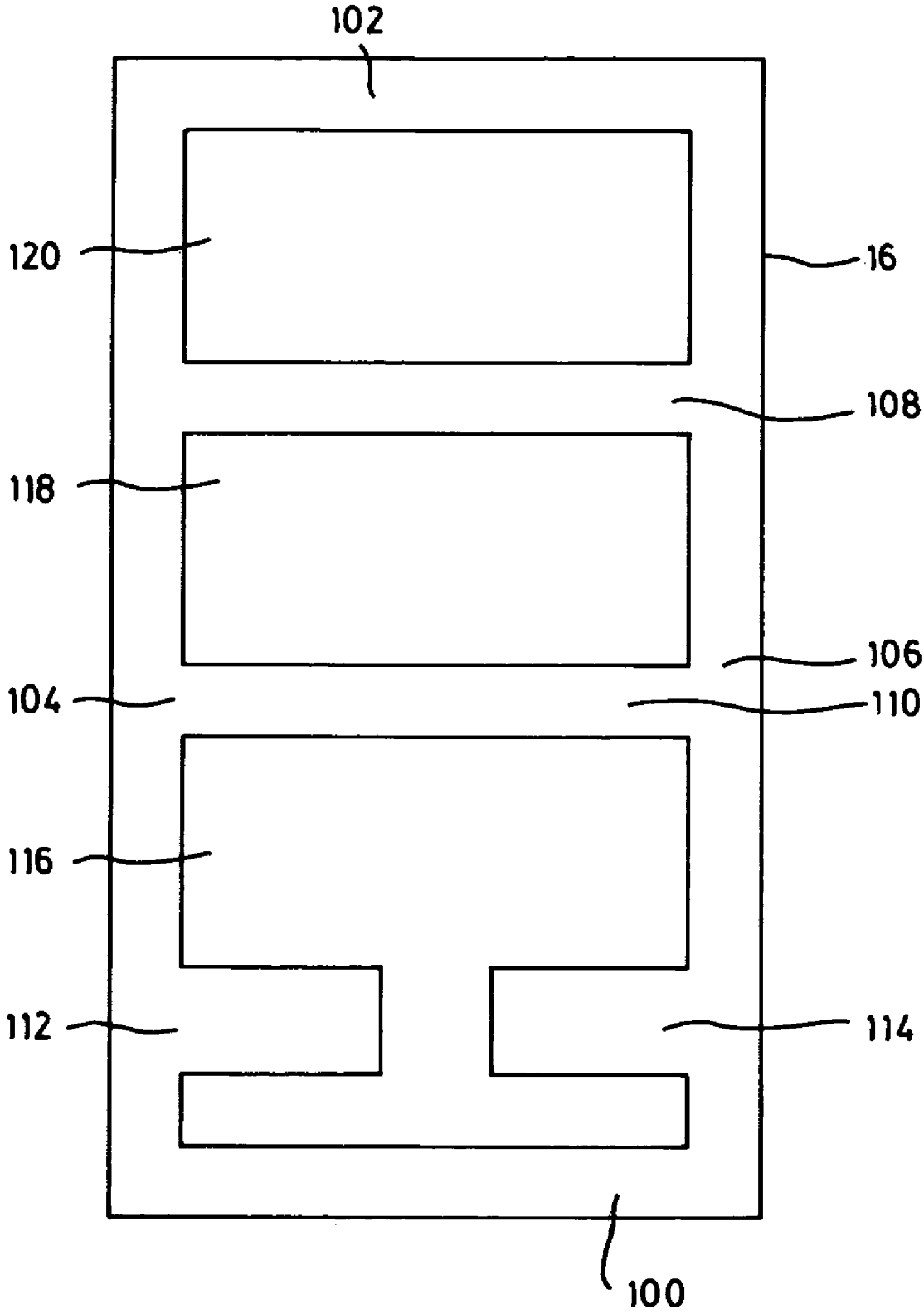
FIG. 6 is a cross section of FIG. 5.

Referring to FIGS. 5 and 6, the stud 16 is shown in more detail. The stud 16 is preferably metal, and more preferably aluminium.

Referring particularly to FIG. 6, a cross section of a stud 16 is shown. The stud comprises a front wall 100, a back wall 102, and side walls 104 and 106 forming a generally rectangular cross-section. A pair of inner walls 108, 110 extend between the side walls 104, 106. The inner walls are preferably perpendicular to the side walls. A pair of flanges 112, 114 partially extend from the respective side walls 104, 106 toward the respective opposite side walls 106, 104. The flanges 112, 114 are situated between the inner walls 108, 110 and the front wall 100. The flanges 112, 114 are preferably perpendicular to the side walls, and aligned with each other. This arrangement provides three cavities 116, 118, 120 within stud 16.

Figure 7:
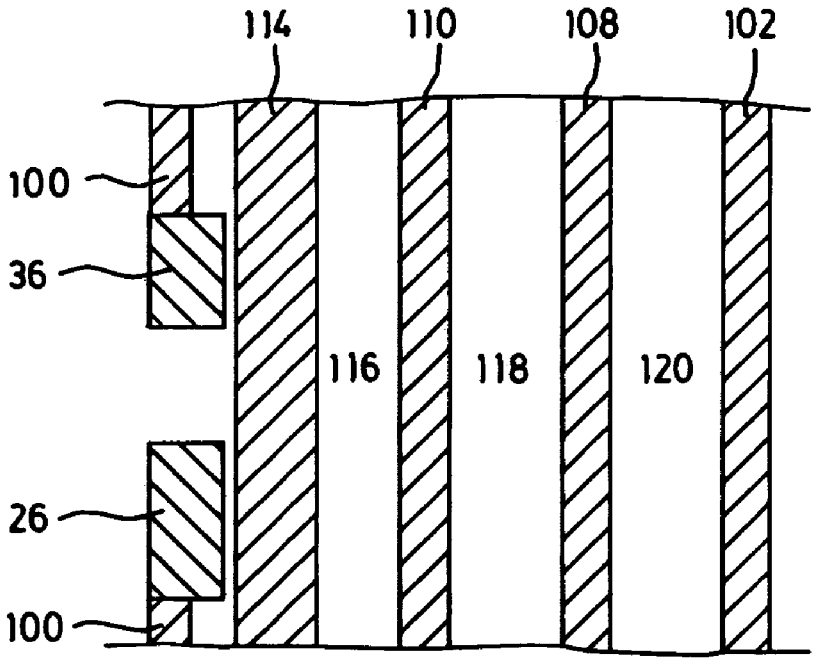
FIG. 7 is a detailed view of a portion of FIG. 1.

Referring to FIG. 7, the interface between the stud 16 and the cross member 18 is shown in more detail. Cross member 18 is oriented with the flanges 24, 34 extending from surface 22 toward stud 16. The front wall 100 of stud 16 has been cut away to receive flat portions 26, 36 of cross member 18 in cavity 116. It will be appreciated that this interface provides a flush surface between the cross member 18 and the stud 16.

Figure 8:
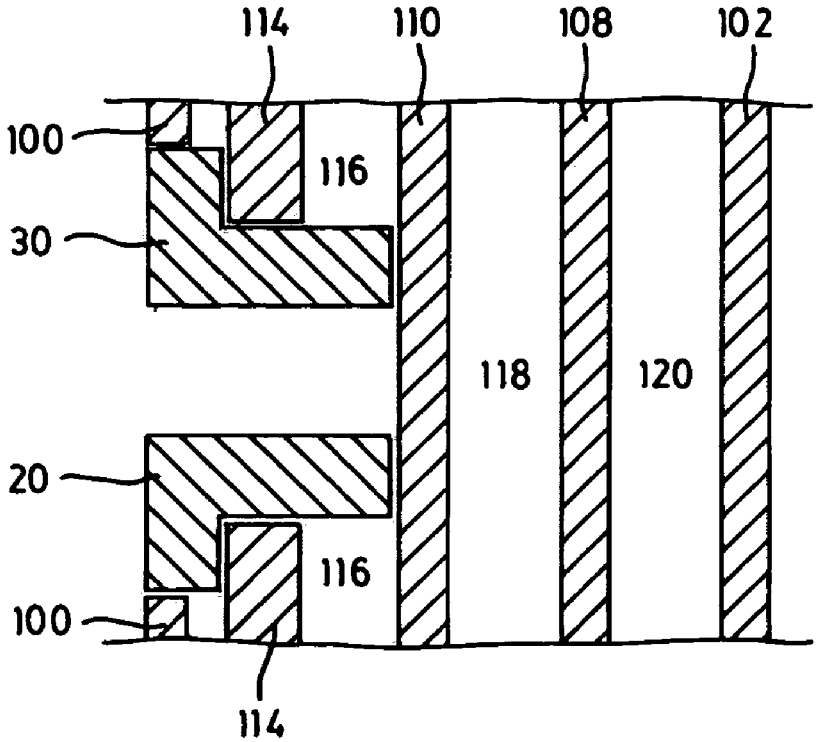
FIG. 8 is a detailed view of another portion of FIG. 1.

Referring to FIG. 8, the interface between stud 16*a* and cross member 18 is shown in more detail. Cross member 18 is oriented with the flanges 24, 34 extending from surface 22 toward stud 16. The front wall 100 and flanges 112, 114 have been cut away to receive members 20, 30 in cavity 116. The surfaces 22, 32 of the members 20, 30 abut flanges 112, 114. The flanges 24, 34 of the members 20, 30 abut inner wall 110. It will be appreciated that this arrangement also provides a flush surface between the cross member 18 and the stud 16*a*.

From the preceding arrangement, it will be seen that when used to build a form, the stud 16 allows a cross member to be mounted flush by cutting away the front wall 100 and the side walls 104 and 106. Still more clearance may be provided by cutting out the flanges 112, 114 for flush mounting as shown in FIG. 8. The inner walls 108, 110 maintain the strength of the stud when the front wall 100 and side walls 104 and 106 around the cavity 116 are removed.

Figure 9:
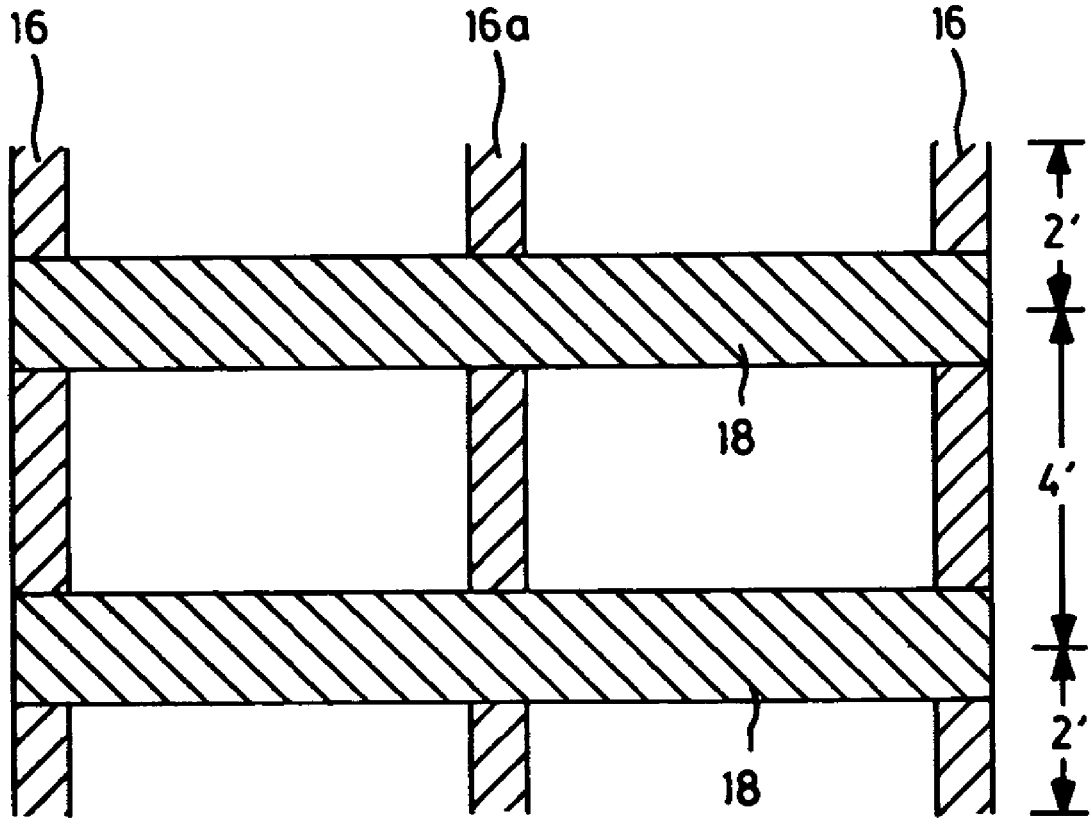
FIG. 9 is a front view of another embodiment of a form.

In a preferred embodiment, the form 10 is assembled by placing three studs 16, 16*a* in a spaced apart arrangement as shown in FIG. 9. The two outer studs 16 are placed at opposite ends of the wood sheet 14. The third stud 16*a* is placed in the middle of wood sheet 14. Each of the studs 16, 16*a* is screwed into wood sheet 14. Two cross members 18 are placed to span the studs 16. The outer studs 16 are cut as shown in FIG. 7 to mate with the end portions of cross members 18. The middle stud 16*a* is cut as shown in FIG. 8 to mate with the centre portion of cross members 18. The cross members 18 are then attached to the studs 16, 16*a* using screws.

This arrangement is particularly suited for attaching a 4'×8' sheet plywood. In this arrangement, the cross members are spaced 4' from each other, and 2' from the respective ends of the studs. Thus two such forms may be stacked by attaching the ends of the studs to obtain regular spacing of 4' between cross members.

It will be recognized that providing a gap between flanges 112, 114 facilitates breaking apart of the stud to allow the arrangements of FIGS. 7 and 8.

With the arrangements shown in FIGS. 7 and 8, one size of screw may be used to attach both configurations.

It will be seen that a form as described in the preferred embodiment will be lighter than a wooden form. Further, the use of metal provides a more resilient form not as susceptible to damage and rot as one made of wood.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A concrete form comprising:

a plurality of cross members;

a sheet of rigid material, such as a wood sheet; and a plurality of studs having:

(a) a front wall, a rear wall, and a pair of side walls, said walls arranged to form a rectangular cross-section;

(b) a pair of inner walls extending between said pair of side walls; and (c) a pair of opposed flanges, each one of said flanges extending substantially perpendicularly from a respective one of said side walls and extending towards the other of said side walls;

wherein a portion of said studs is adapted for complementary engagement with said cross members, said cross members connecting at least two of said studs and being attached to at least one of said inner walls and said flanges of said cut portion of said studs, and said sheet of rigid material is mounted to said rear wall;

and wherein said cross members include end cross members and center cross members, said center cross members being attached to said inner walls and said end cross members being attached to said flanges.

2. A concrete form according to claim 1 wherein at least one of said studs is cut to form a shape complementary to the respective cross member attached thereto.

3. A concrete form according to claim 1 wherein each of said studs attaches to the respective cross member with the same length screw.

4. A concrete form comprising a pair of opposing panels, each of said panels comprising:

(a) a plurality of studs arranged in a spaced apart parallel manner with respect to each other, each of said studs comprising a generally hollow elongate member having:

(i) a front wall, a rear wall, and first and second side walls, said side walls being spaced apart from each other and each extending between said front and rear walls to provide the stud with a generally rectangular cross-section;

(ii) at least one rib extending between and connecting said pair of side walls; and, (iii) a pair of opposed flanges, each one of said flanges extending substantially perpendicularly from a respective one of said side walls and extending towards the other of said side walls;

said studs being arranged in a planar manner with the respective front and rear walls extending in the same direction;

(b) a plurality of cross members, extending perpendicularly between and connected to at least two of said studs and being arranged in a spaced apart parallel manner with respect to each other, said cross members being provided generally perpendicular to said studs and connected thereto, and wherein said cross members are provided adjacent the front walls of said studs and wherein said cross members include a narrow portion and a wide portion forming a generally "T" shaped structure; and, (c) a sheet of rigid material, such as a wood sheet, overlying and connected to the rear walls of said plurality of studs;

wherein said studs are adapted for complementary engagement with said cross members, said cross members being attached to at least one of said rib or said flanges of a cut portion of said studs;

and wherein said panels are arranged in a parallel and spaced apart relationship to each other with said sheets of rigid material facing each other.

5. The form of claim 4 wherein the narrow portions of said cross members are received against the at least one rib of said studs.

6. The form of claim 5 wherein the wide portions of said cross members are received against the flanges of said studs and wherein said wide portions are connected to said flanges.

7. The form of claim 4 wherein said panels are connected together in a spaced apart arrangement thereby forming a planar space there between.

8. The form of claim 4 provided in a kit format comprising components for assembly.

* * * * *